US007444843B2

(12) United States Patent
Ozturk et al.

(10) Patent No.: US 7,444,843 B2
(45) Date of Patent: Nov. 4, 2008

(54) DRUM

(76) Inventors: Umud Esat Ozturk, Arcelik A.S., E5 Ankara Asfalti Uzeri, Tuzla, Istanbul (TR); Nihat Yavuz, Arcelik A.S., E5 Ankara Asfalti Uzeri, Tuzla, Istanbul (TR); Bertan Bayram, Arcelik A.S., E5 Ankara Asfalti Uzeri, Tuzla, Istanbul (TR); Avci Korkut, Arcelik A.S., E5 Ankara Asfalti Uzeri, Tuzla, Istanbul (TR); Dogan Demirhan, Arcelik A.S., E5 Ankara Asfalti Uzeri, Tuzla, Istanbul (TR); Nursan Kemerdere, Arcelik A.S., E5 Ankara Asfalti Uzeri, Tuzla, Istanbul (TR)

( * ) Notice: Subject to any disclaimer, the term of this patent is extended or adjusted under 35 U.S.C. 154(b) by 482 days.

(21) Appl. No.: 10/514,874

(22) PCT Filed: May 16, 2003

(86) PCT No.: PCT/TR03/00043

§ 371 (c)(1),
(2), (4) Date: Nov. 15, 2004

(87) PCT Pub. No.: WO03/097919

PCT Pub. Date: Nov. 27, 2003

(65) Prior Publication Data

US 2005/0103060 A1 May 19, 2005

(30) Foreign Application Priority Data

May 17, 2003 (TR) ..... A 2002 01346

(51) Int. Cl.
*D06F 37/04* (2006.01)

(52) U.S. Cl. ..... 68/142; 68/20; 68/139; 68/143; 34/596; 34/602

(58) Field of Classification Search ..... 68/142, 68/143, 20, 139; 34/596, 602
See application file for complete search history.

(56) References Cited

U.S. PATENT DOCUMENTS 2,855,698 A * 10/1958 Hutt ..... 34/108
4,484,461 A * 11/1984 Parks et al. ..... 68/142
5,167,898 A 12/1992 Luther
5,746,070 A * 5/1998 Bailey et al. ..... 68/24

(Continued)

FOREIGN PATENT DOCUMENTS

DE 12 36 457 B 3/1967

(Continued)

*Primary Examiner*—Joseph L Perrin
(74) *Attorney, Agent, or Firm*—Venable, Campillo, Logan & Meaney PC

(57) ABSTRACT

The present invention is related to a drum (1), used in washing machines, preferably laundry machines, into which laundry to be washed is to be placed, capable of performing washing by rotational movement around its central axis, preferably made of plastic, comprising a main body (2) and a rear cover (3), whereby said rear cover (3) comprises a circular edge (10) which surrounds the main body (2) and the main body (2) comprises an edge socket (14) in which the rear cover edge is located, the main body (2) and the rear cover (3) being connected to each other without forming any protrusion on the outer face of the drum (1).

21 Claims, 10 Drawing Sheets

U.S. PATENT DOCUMENTS 6,401,363 B1 * 6/2002 Miramondi ..... 34/602

FOREIGN PATENT DOCUMENTS

| | | | |
|---|---|---|---|
| EP | 0 789 104 A | | 8/1997 |
| GB | 853 824 A | | 11/1960 |
| GB | 2 333 300 A | | 7/1999 |
| WO | WO 98 48095 A | | 10/1998 |
| WO | WO 01 44556 A | | 6/2001 |

* cited by examiner

DRUM

BACKGROUND OF THE INVENTION

The present invention is related to a drum of plastic material used in washing or drying machines, preferably front-loading washing machines, capable of performing washing operation by rotating.

In the state of the art washing machines, preferably laundry machines comprise a fixed tub and a drum rotating inside such a tub. As an outcome of unbalanced distribution of laundry inside the revolving drum, during the washing, the centre of gravity of objects spinning around drum axis in laundry machines goes away from rotational axis. Thus, centrifugal forces affect all the components of washing machines, particularly the fixed tub and the revolving drum. It is preferred to produce revolving drums from metal plates instead of plastic materials with respect to strength against excessive load and methods of manufacturing.

U.S. Pat. No. 5,167,898 describes a mold group enabling production of a single piece plastic drum comprising perforations with openings in the form of teardrops.

In the EP 0595040, a tub is described having perforations formed by cutting from projections outside which are inside towards extending from outside in order to prevent harming of the laundries inside the tub by the flash.

In EP0854223, a fastening method by riveting for a plastic tub is described.

In the EP 0789104 a system of fastening for holding a plastic tub made of two pieces by using claws, is described.

SUMMARY

The object of this invention is to achieve a plastic drum rotating around its central axis for household appliances, preferably for laundry machines.

DRAWINGS

Figure 1:
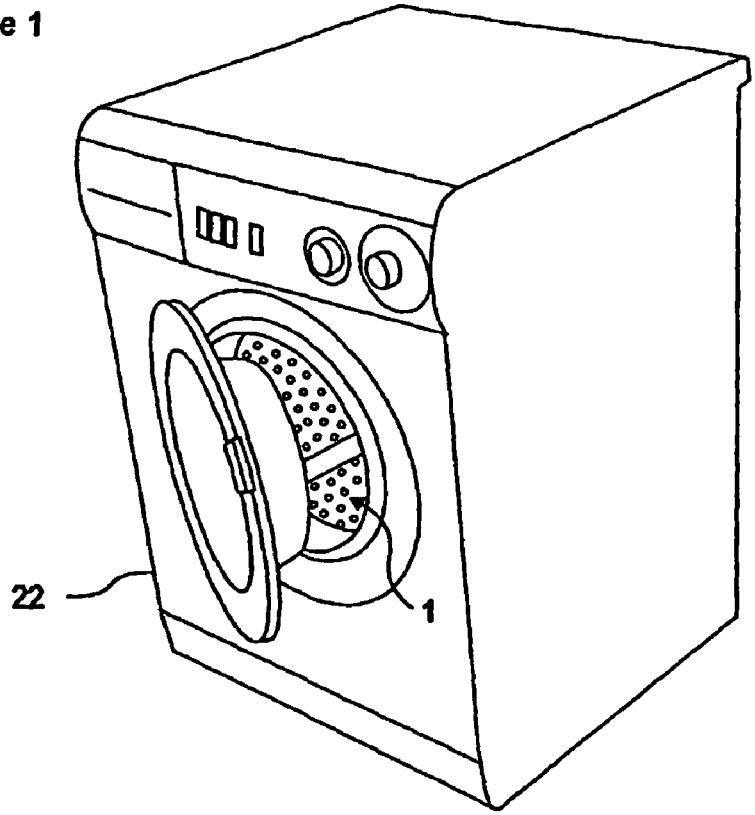

Drum embodied to attain the objects of this invention has been shown in figures attached, where FIG. 1 is a three-dimensional front view of a washing/drying machine.

Figure 2:
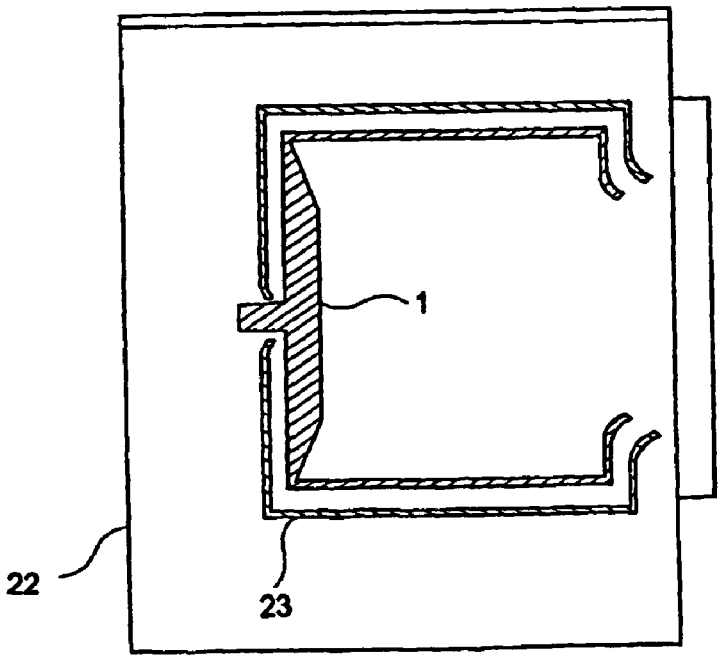

FIG. 2 is a schematic view of a washing/drying machine comprising a drum and a tub.

Figure 3A:
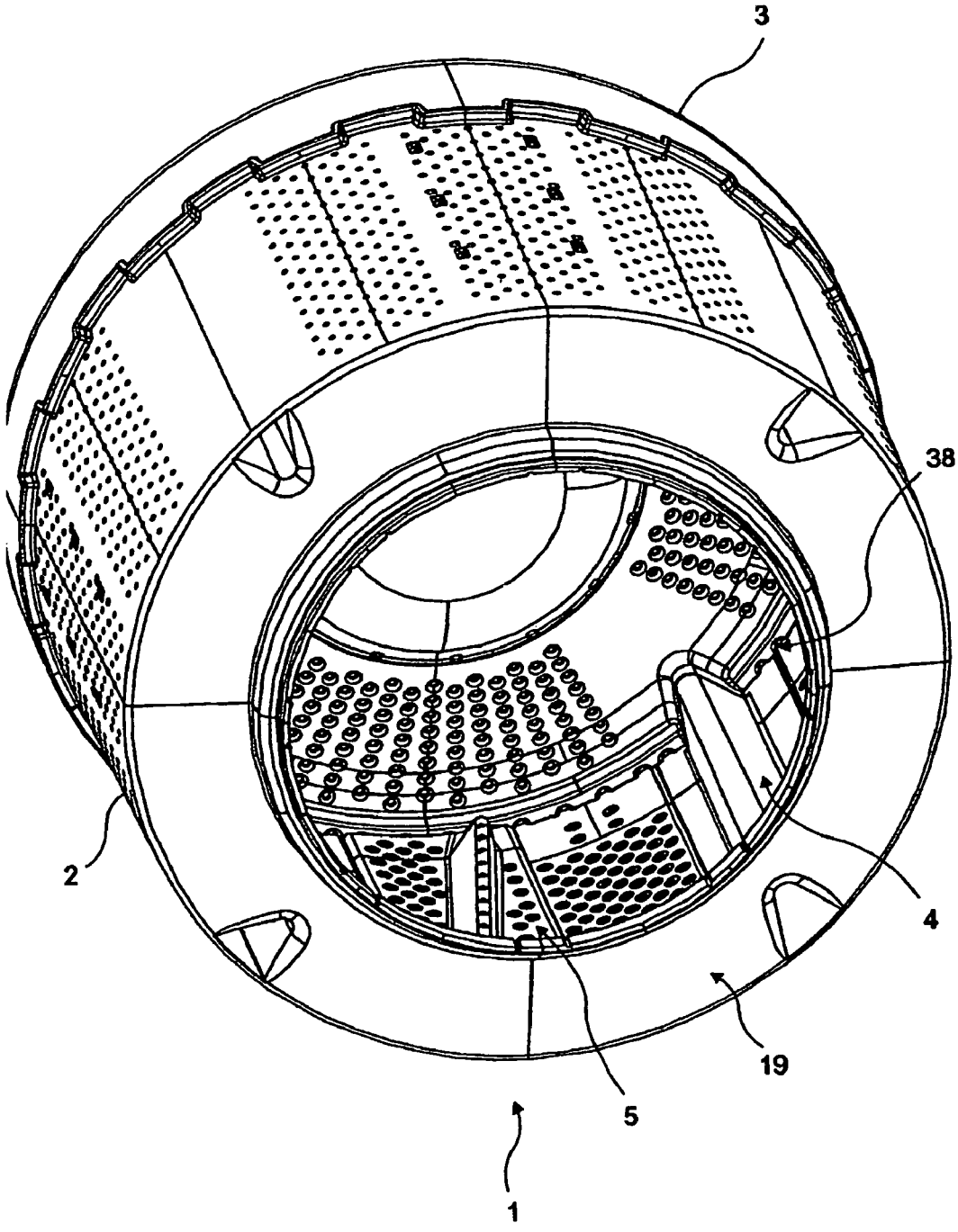
Figure 3B:
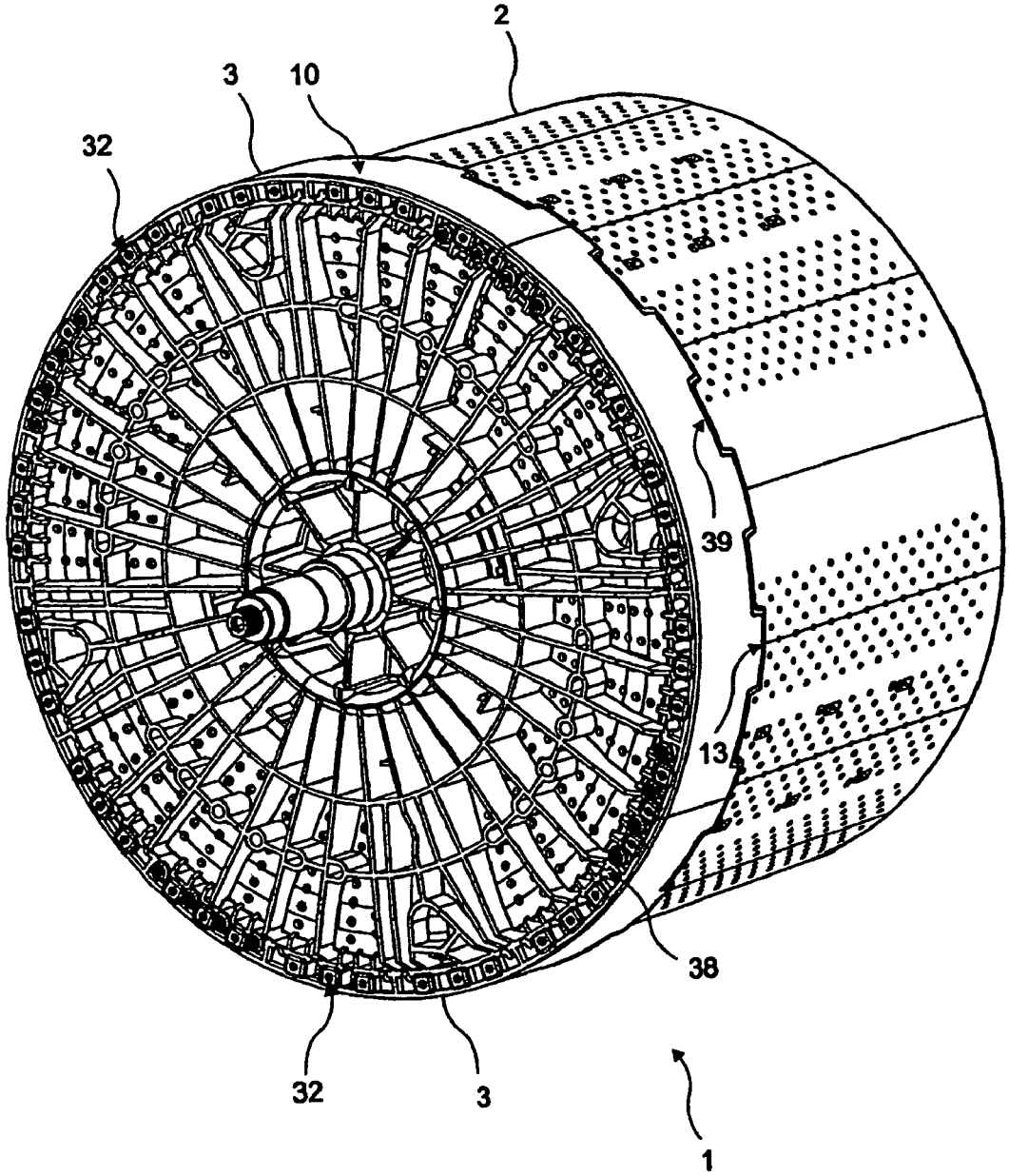

FIG. 3*a* is a three-dimensional front view of a drum,

FIG. 3*b* is a three-dimensional rear view of a drum.

Figure 4A:
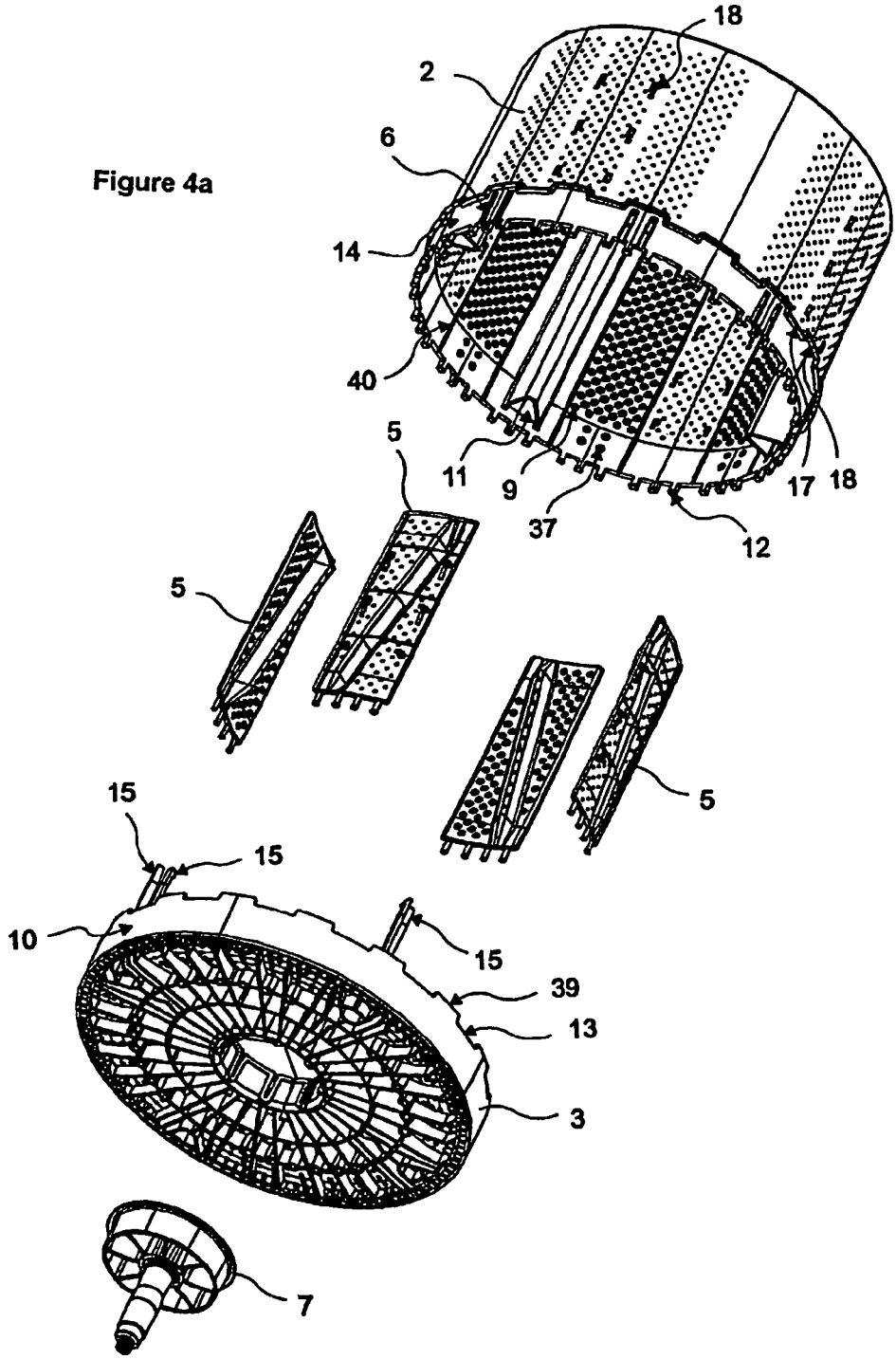

FIG. 4*a* is an exploded rear three-dimensional view of a drum.

Figure 4B:
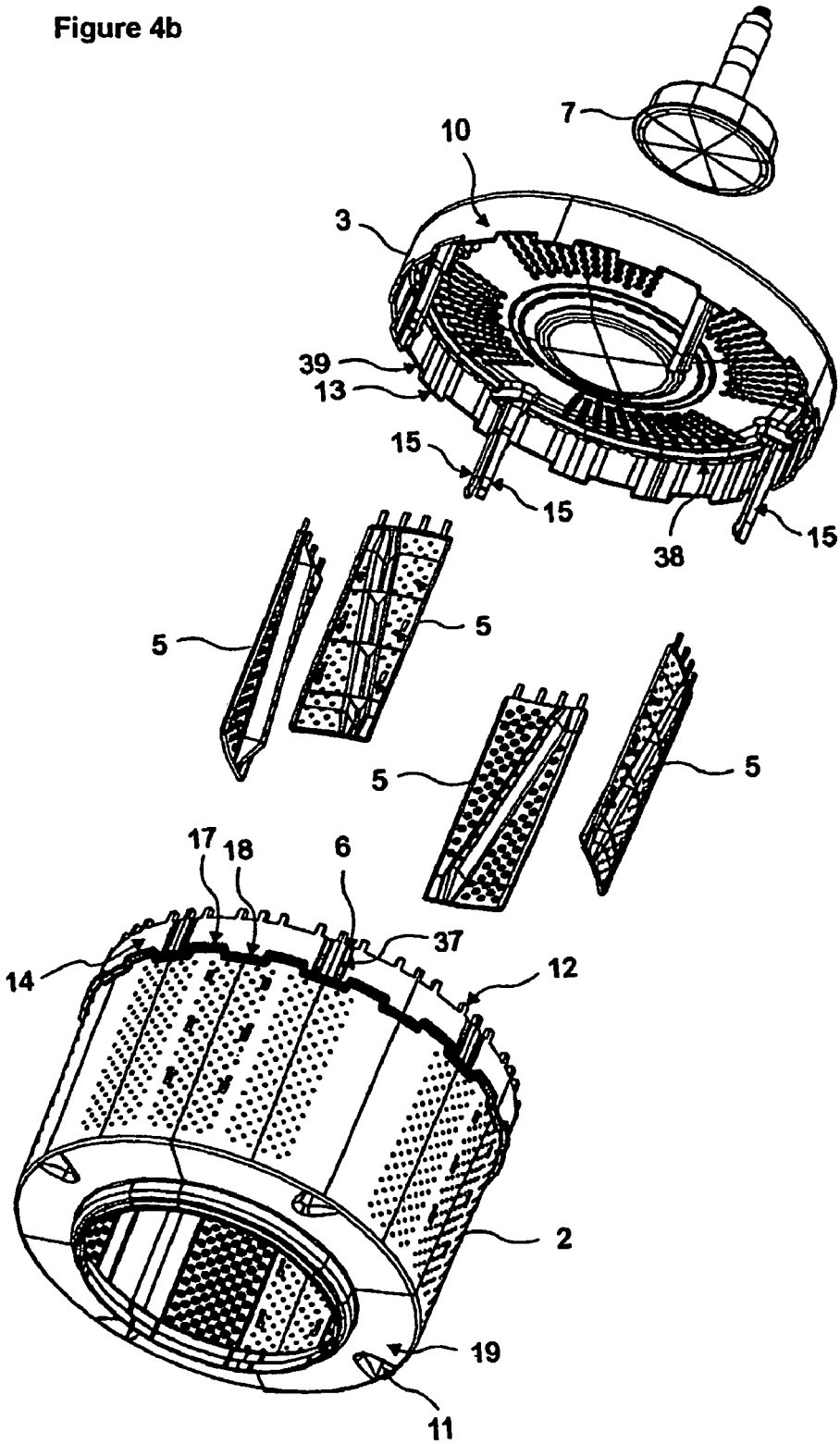

FIG. 4*b* is an exploded three-dimensional front view of a drum.

Figure 5A:
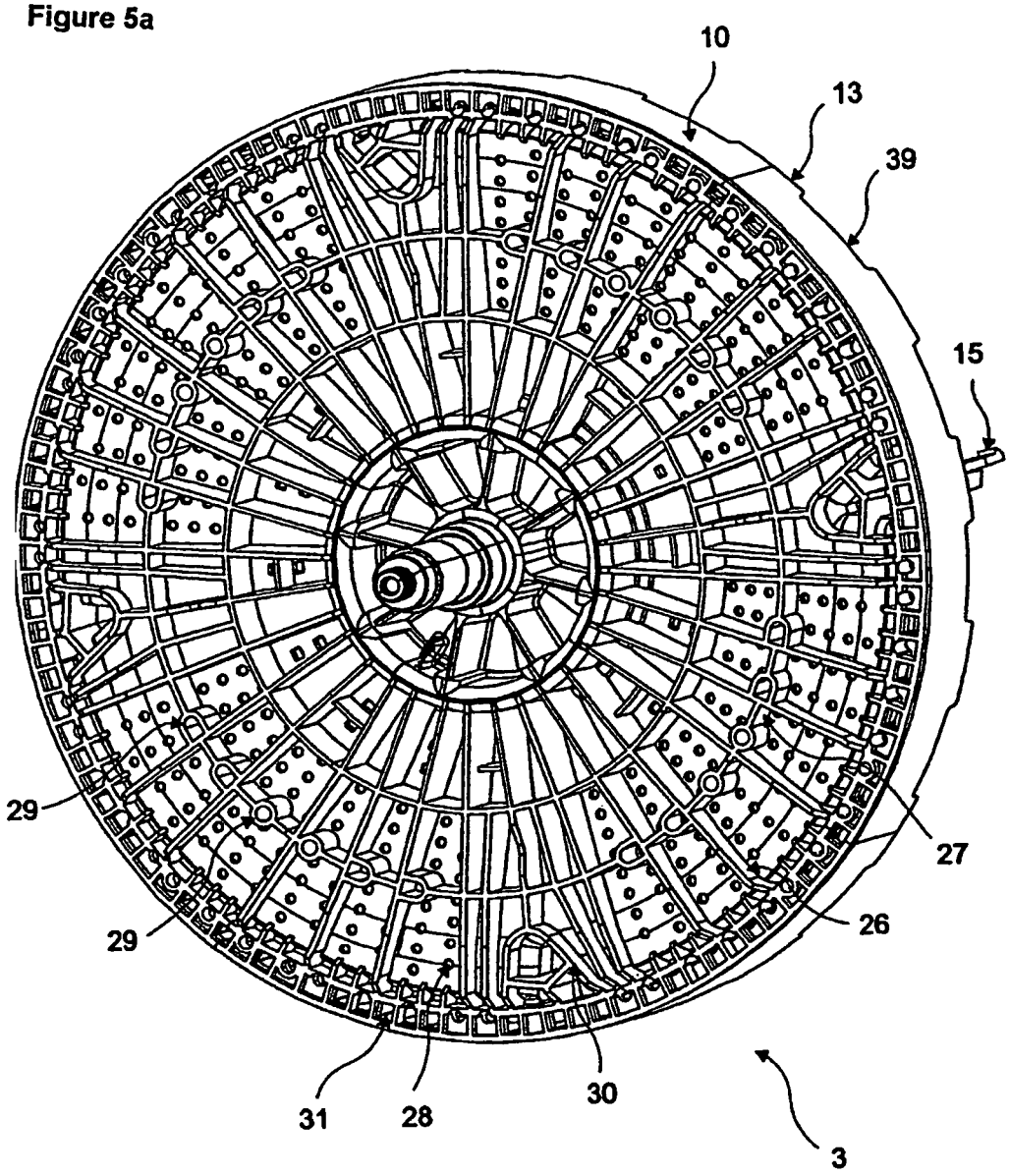

FIG. 5*a* is a three-dimensional rear view of back cover.

Figure 5B:
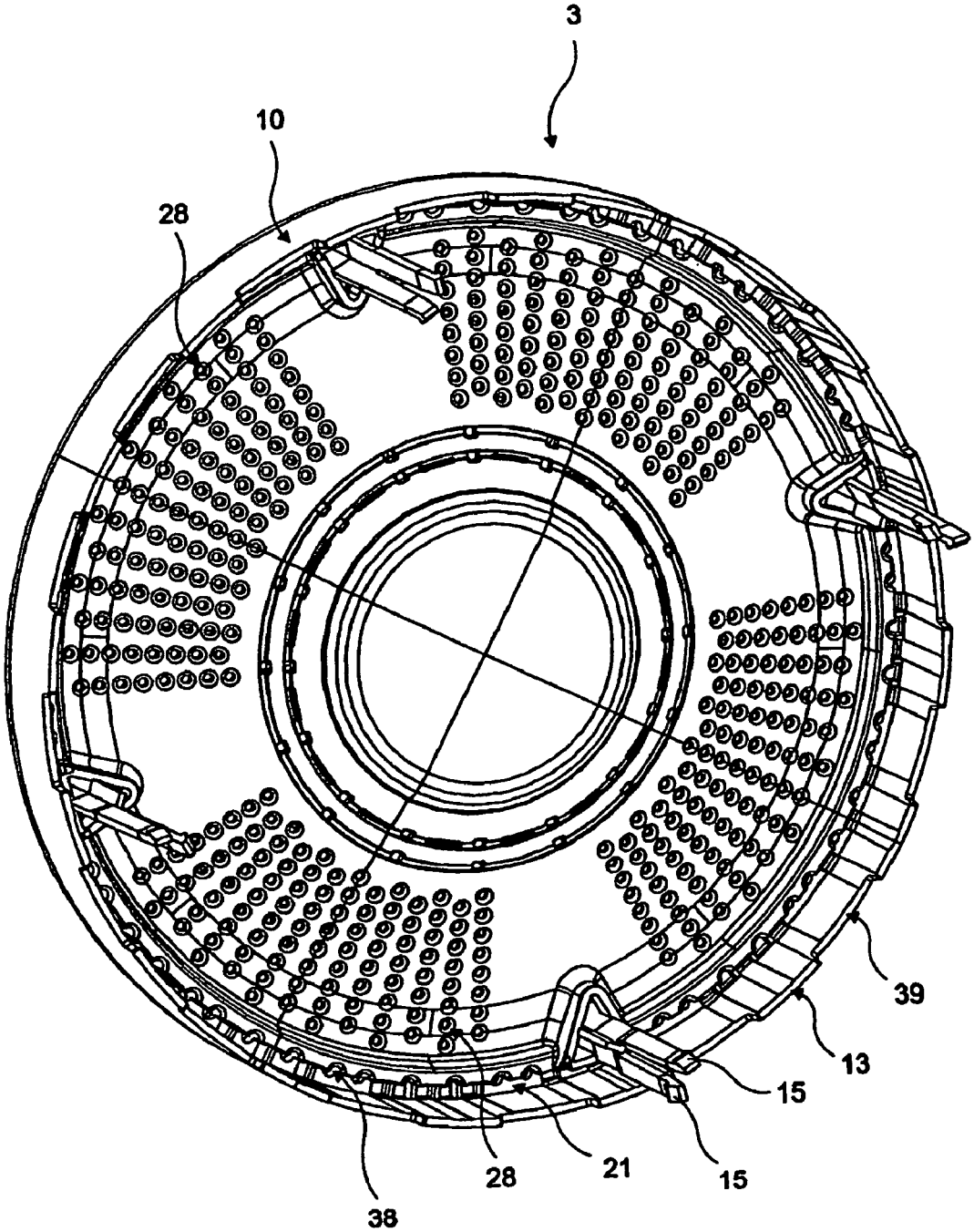

FIG. 5*b* is a three-dimensional front view of back cover

Figure 6A:
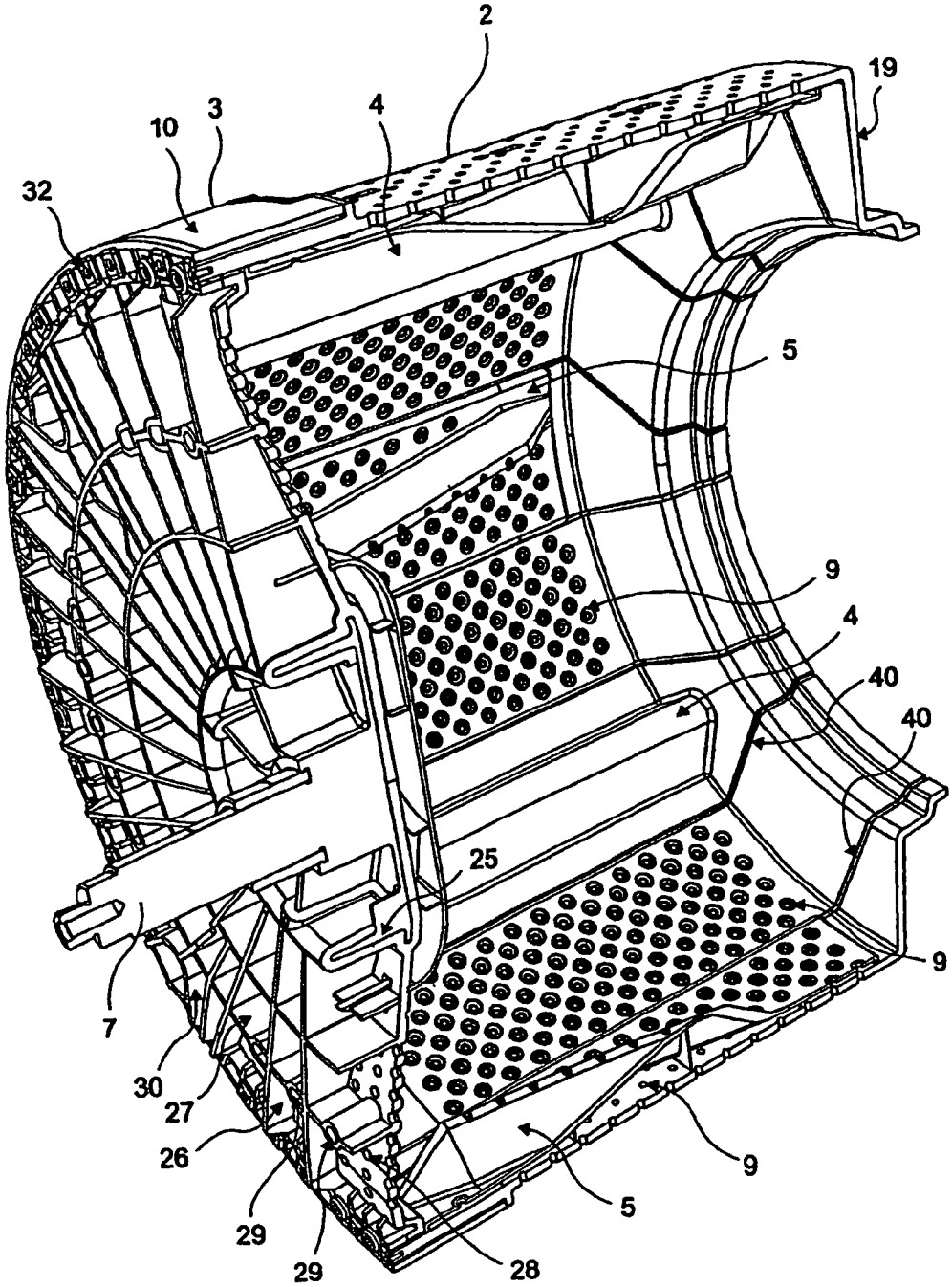

FIG. 6*a* is a perspective rear view of a drum cut into half

Figure 6B:
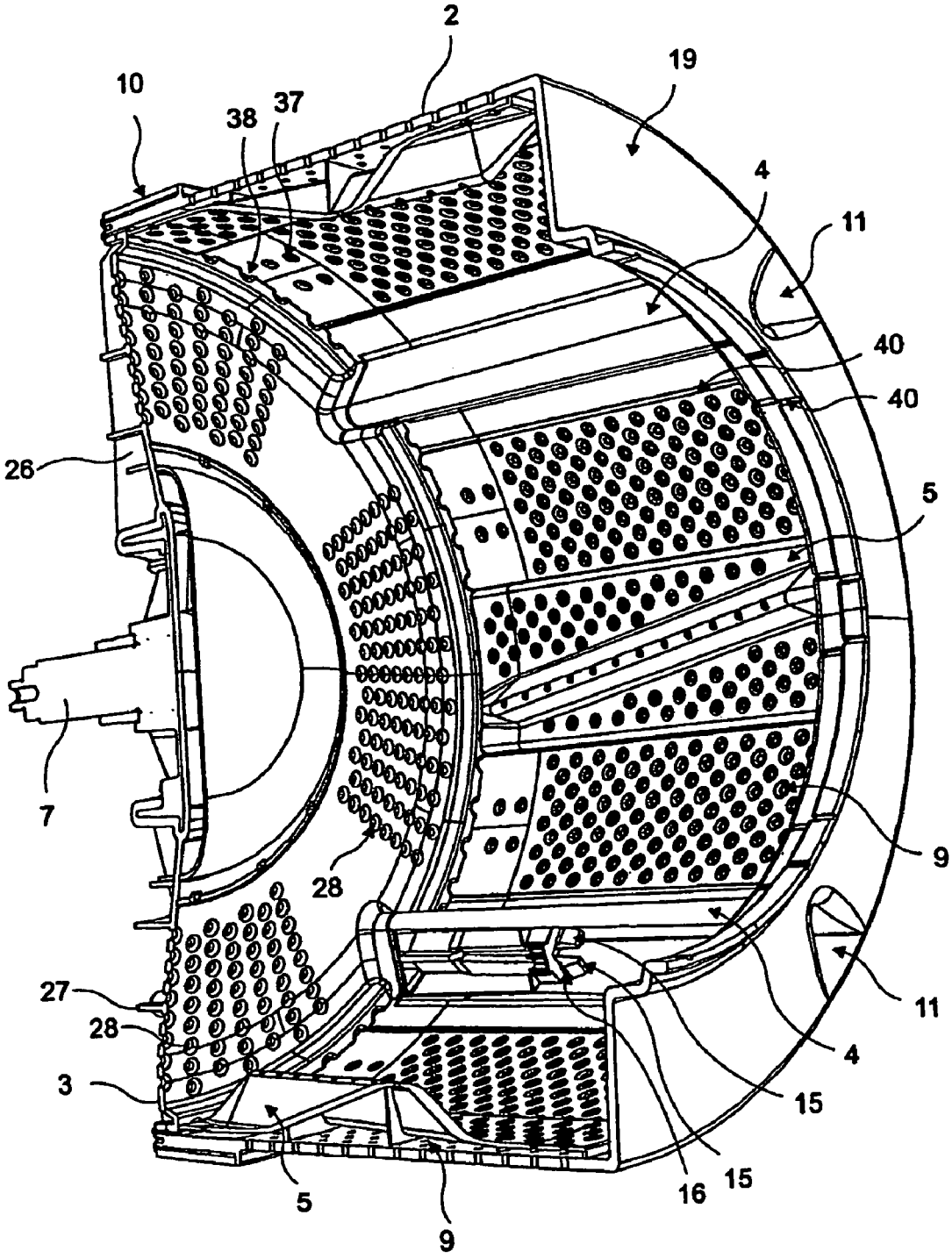

FIG. 6*b* is a perspective front view of a drum cut into half

Figure 7A:
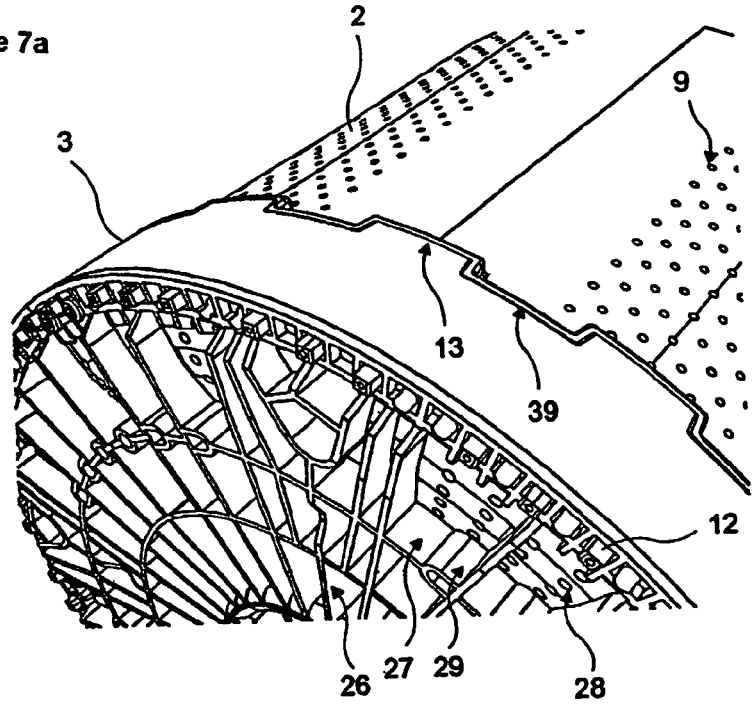

FIG. 7*a* is a perspective view taken before rivets, which ensure joining main body and rear part together, are crushed.

Figure 7B:
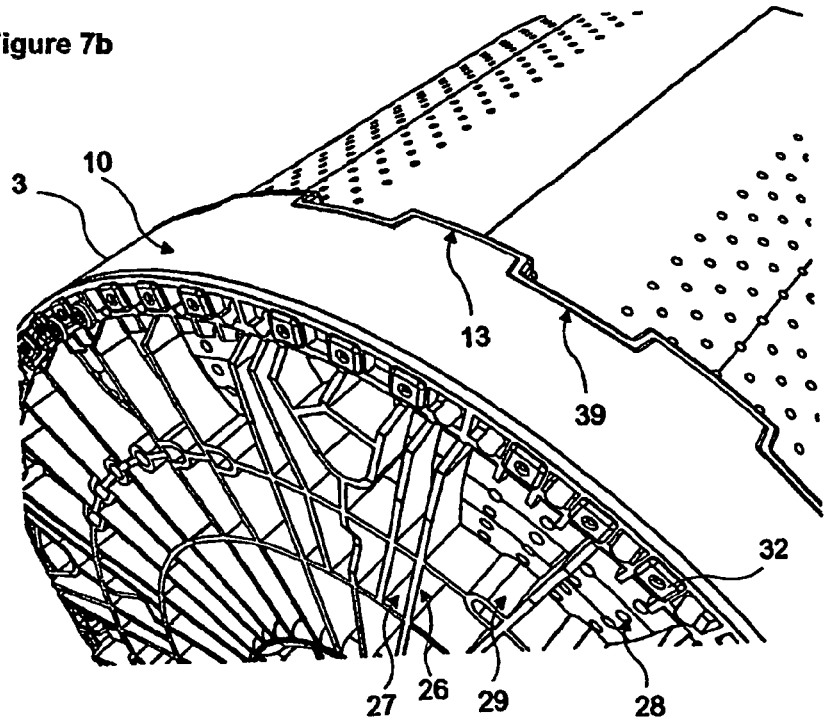

FIG. 7*b* is a perspective view taken after rivets, which ensure joining main body and rear part together, are crushed.

DESCRIPTION

The parts are numbered as follows:

1—Drum
2—Main body
3—Rear cover
4—Rib

5—Attachable plate
6—Discharge duct
7—Torque conveyor
9—Body hole (orifice)
10—Edge
11—Rib gap
12—Rivet projection
13—Edge coupling extension
14—Edge socket
15—Drum claw
16—Drum claw recess
17—Edge socket coupling projection
18—Edge socket coupling recess
19—Front surface
21—Resting duct
22—Washing/drying machine
23—Tub
26—Angular cover support
27—Circular cover support
28—Cover slot
29—Support ring
30—Curved cover support
31—Rivet socket
32—Rivet head
37—Duct discharge hole
38—Drum discharge hole
39—Edge coupling recess
40—Trace hiding socket Washing/drying machines, preferably in front loading washing machines, a motor is provided to activate the machine, a fixed tub (23) into which the washing fluid is filled and discharged, a drum (1) made of a non-filler polymeric material such as a thermoplastic material or a material with filler such as fiber, calcium carbonate into which laundries to be washed are placed, rotating by the motor around its central axis. Drum (1) comprises a main body (2) and a rear cover (3).

Rear cover (3) comprises a circular edge (10) surrounding the main body (2). Edge (10) comprises more than one edge coupling extension (13) and more than one edge coupling recesses (39) ensuring rear cover (3) to facilitate the rotation of the main body (2).

The main body (2) comprises an edge socket (14) into which an edge (10) is located on its outer surface. Edge socket (14) comprises an edge socket coupling recess (18) fitting into the edge coupling projection (13) and an edge socket coupling projection (17) fitting into the edge coupling recess (39). On the edge socket (14), a discharge duct (6) is provided to facilitate discharge of washing fluids. On the discharge duct (6), one or more discharge holes (37) opening into the inner wall of the main body (2) are provided. On rear cover (3), at a location where the edge (10) meets back cover (also called a "rear cover" herein) (3), there is a resting duct (21) on which the edge socket (14) projection rests. Inside the resting duct (21), there are one or more drum discharge holes (38) ensuring discharge of washing fluid accumulated on the connecting edge between rear cover (3) and main body (2).

The rear cover (3) comprises a torque conveyor (7) made of a material different from that of the drum, transferring the power from the motor to the drum to rotate the drum (1). Torque conveyor (7) is preferably made of aluminum material to reduce weight and to increase strength.

On the rear cover (3), there are one or more angular cover supports (26) and one or more circular cover supports (27) located as intersecting each other around torque conveyor (7) to enhance rear cover (3) resistance against forces formed on rear cover as a result of centrifugal forces. At parts where angular cover supports (26) and angular cover supports (27)

are not correspond and where it is required to provide some further strength, cover curving supports (30) are placed in these parts in required number and corresponding forms.

On angular cover supports (26) and on circular cover supports (27), preferably at crossings, there are more than one reinforcing support rings (29) in curved form. One or more cover perforations (28) preferably in circular form to facilitate the transmission of fluids and gases in drum (1) during the washing or drying cycle are provided between angular cover supports (26) and circular cover supports (27).

On the inner wall of the rear cover (3), one or more drum claws (15) are provided for the mounting preferable in various directions onto the main body (2).

In front of the main body (2), there is a front surface preferably in the form of a ring (19), whereas on the inner surface thereof, one or more body holes (9) to transfer fluids which the body contains, one or more trace concealing sockets (40) hiding the flash, which might have formed due to mold extraction from the inner surface during its production and one or more ribs (4) produced as single-piece with the main body, to activate laundry to be dried or washed by rotational movement of drum (1) so as to increase drying or washing efficiency. Rib (4) comprise a rib gap (11) and a drum claw (16) fixing to the main body and rear cover (3) by claw locking the drum claw (15) into the rib gap (11).

On the main body (2), there is one or more rivet projections (12) preferably of rectangular shape, and rivet recesses (31) in corresponding number and shape of rivet projections (12) so as to hold them on the rear cover (3).

The drum (1) contains one or more attachable plates (5) that have one or more rib holes to transmit fluids and gases, and can be mounted whenever desired by the manufacturer, but cannot be moved away by user without seeking help from the manufacturer.

In another embodiment of the invention, attachable plate (5) is not utilized and body holes (9) are not drilled at parts where attachable rib (5) exists.

While the drum is manufactured, the torque conveyor (7), which is manufactured beforehand, is positioned into the mold preferably with the aid of a mold centering projection. Plastics are injected into the mold to ensure that a part of the torque conveyor (7) is retained inside the rear cover material. At the same time, cover slots (28) are opened from the rear cover (3) inner wall towards the rear cover (3) outer wall by the help of inserts, preferably with countersink. In this way, formation of flash, inside the drum (1), particularly on and over the cover slots (28), causing damage to laundries are eliminated. Mold is opened to extract in single-piece rear cover (3) embodying torque conveyor (7). The main body (2), in turn, is manufactured with plastic injection as a single piece with ribs (4). In order to prevent the formation of flash, which harms laundry to be dried and washed, body holes (9) at parts where ribs (4) do not exist are drilled countersunk by means of cores from the drum inner wall towards its outer wall. Hiding the flash, which insert edges may leave behind on inner wall of the main body (2) is provided by using trace-concealing socket (40). For inserts to operate in the closed inner volume of the main body and for removing the main body (2) from the mold, it is not possible to drill perforations at some parts of the main body (2). If it is desired to drill perforations at such sites, using outer inserts, body perforations from outside to inwards are drilled. However, body perforations drilled there may cause flash at the inner side of the main body which harms laundry that will be washed or dried. In order to prevent such flash to harm laundries, attachable plates (5) having rib holes with countersink, manufactured as hollow and separately from the main body (3) in order eliminate imbalance of load distribution and not to prevent circulation of washing the fluid, are used over these harmful holes including flash. In this way, conveyance of flux such as gases and fluids existing there is also provided.

After attachable plates (5), rear cover (3) and the main body (2) are manufactured, and after attachable plates (5) are mounted on to the main body (3), drum claws (15) are fixed by pushing into drum claw recess (16) and in the meantime, the edge (10) seats on edge socket (14) such that edge coupling extension (13) fits into the edge piece coupling recess (18), and the edge coupling recess (39) fits into the edge coupling projection and rivet projections (12) on the main body (2) are located inside the rivet cap (31) on the rear cover (3). After the drum claws (15) are placed inside the drum claw recess (16), rivet projections (12) on the main body (2) are heated and pressed thereto, rivet heads (32) in number as much as number of rivet projections (12) and of width sufficient to prevent them to release from their housings are formed. So, on the rear cover (3), fixing is provided on several points and the main body (2) is fixed, without using any additional piece, with attachable plates and the rear cover (3).

Particularly, for drums (1) working under heavy torque conditions, and/or at high speed edge (10) and edge socket (14) are welded to each other using plastic fastening methods such as friction weld, hot point welding, laser welding to fix them.

In another embodiment of the invention, the edge (10) and edge socket (14) are fixed to each other using fastening means such as rivets or screws.

By means of connecting edge (10) to edge socket (14), the main body (2) and the rear cover (3) are fixed to each other and the drum (1) is formed without any projection being apparent on its outer face. In this way, the drum (1) rotates inside the tub (23) in any direction around its axis, without causing any harm to tub.

As the drum (1) is made of polymeric materials, pieces, which form the drum (1) may be produced in the same, different or in transparent colors.

The invention claimed is:

1. A drum (1) used in a washing/drying machine, wherein the washing/drying machine comprises a motor, a fixed tub (23) which holds the washing fluids, and the drum (1) located inside fixed tub (23), to take in laundries to be washed and dried; by which washing/drying is provided by rotating it by means of the motor around its central axis, and made of a polymeric material with or without filler; the drum (1) comprising a main body (2) and a rear cover (3), wherein said rear cover (3) comprises a circular edge (10) which surrounds and seats on the main body (2) at its edge wherein the said circular edge (10) has more than one edge coupling extension (13) and more than one edge coupling recess (39) at its tips and the main body (2) comprises an edge socket (14) in which the edge (10) is located wherein the edge socket (14) comprises an edge coupling extension (13) suitable to edge socket coupling recess (18), and edge coupling projections (17) suitable to the edge piece coupling recesses (39) such that the edge coupling extension (13) fits into edge socket coupling recess (18) and edge coupling projections (17) fit into edge piece coupling recesses (39).

2. A drum (1) as defined in claim 1 wherein the said edge coupling extensions (13) and the edge coupling recesses (39) form a tooth like structure engaging with a tooth like structure formed by the edge socket coupling recesses (18) and the edge coupling projections (17).

3. A drum (1) as defined in claim 1 wherein the main body (2) has edge socket (14) comprises a discharge duct (6) to facilitate the discharge of washing fluids on its outer surface and one or more discharge outlets (37) which open into the inner surface of the main body (2) on the discharge duct (6).

4. A drum as defined in claim 1 wherein the rear cover (3) comprises a resting duct (21) onto which the edge socket (14) rests and where the edge (10) is joined.

5. A drum (1) as defined in claim 1 wherein the rear cover (3) comprises one or more drum discharge outlets (38) providing discharge of washing fluid collected on the edge where the rear cover connects to the main body (2) inside the resting duct (21).

6. A drum (1) as defined in claim 1 wherein with the main body comprises a front surface (19) in the preferably in the shape of a ring, one or more body holes (9) on its inner face to transmit the fluids inside the body, one or more trace concealing sockets (40) to hide the burrs formed due to mould pieces which remained on its inner wall in the course of mould extraction.

7. A drum (1) as defined in claim 1 wherein with the main body (2) comprises one or more ribs (4) manufactured preferably in a single-piece with the said body, which improves the washing efficiency by activating laundries to be washed through a rotational movement of the said drum.

8. A drum (1) as defined in claim 7, wherein the main body (2) comprises a rib (4) having a rib gap (11).

9. A drum (1) as defined in claim 8 wherein the rear cover (3) comprises more than one claw (15) for mounting onto the main body (2) preferably in various directions by sliding into rib gap (11).

10. A drum (1) as defined in claim 9 wherein the main body (2) comprises a draw claw recess (16) to fix the main body (2) and the rear cover (3) together by placing the draw claw (15) into the rib gap (11) for claws locking.

11. A drum (1) as defined in claim 1 wherein the main body (2) comprises rivet projections (12) the preferably in rectangular shape to reinforce connection with the rear cover (3).

12. A drum (1) as defined in claim 11 wherein the rear cover (3) comprises rivet sockets (31) in corresponding number and shape with the rivet projections (12), into which the said rivet projections (12) are placed.

13. A drum (1) as defined in claim 12 wherein the main body (2) comprises rivet heads (32) made by heating the rivet projections (12) and pressing them of width sufficient to prevent the rivets are not released from their sockets.

14. A drum (1) as defined in claim 1 wherein the rear cover (3) comprises a torque conveyor (7) to transmit power from motor to enable rotation on its outer surface that does contact the laundry manufactured as single-piece with this former from a material different than one by which this former is manufactured.

15. A drum (1) as defined in claim 14 wherein the rear cover (3) comprises more than one angular cover supports (26), more than one circular cover supports (27) and more than one cover curving supports (30) of appropriate form to be placed at sites where angular and circular covers do not correspond and require strengthening, located around torque conveyor to enhance strength against forces formed due to centrifugal forces.

16. A drum (1) as defined in claim 15 wherein the rear cover (3) comprises one or more curved reinforcing support rings (29) on angular (26) and circular (27) cover supports preferably at junctions.

17. A drum (1) as defined in claim 16 wherein the rear cover (3) comprises one or more cover lot (28), preferably circular and located between the annular cover supports (26) and circular cover supports (27), to facilitate the transmission of fluids and gases accumulated inside drum (1) during washing or drying.

18. A drum (1) as defined in claim 1 wherein attachable plates (5) that can be mounted according to manufacturer's options but cannot be removed by user without the help of the former.

19. A drum (1) as defined in claim 1 wherein formed pieces are of the same colors.

20. A drum (1) as defined in claim 1 wherein formed pieces are of different colors.

21. A drum (1) as defined in claim 1 wherein formed pieces are of transparent colors.

* * * * *